United States Patent [19]

DeMatteo et al.

[11] Patent Number: 4,783,350

[45] Date of Patent: Nov. 8, 1988

[54] FULL FACE DECORATIVE APPLIQUE

[75] Inventors: Dawn DeMatteo, Lake Hiawatha, N.J.; David Mamberg, Scarsdale, N.Y.

[73] Assignee: Cosrich, Incorporated, Perth Amboy, N.J.

[21] Appl. No.: 75,102

[22] Filed: Jul. 20, 1987

[51] Int. Cl.[4] ..... A41G 7/00; B41M 3/12

[52] U.S. Cl. ..... 428/16; D21/190; 156/267; 428/43; 428/79; 428/919; 446/27

[58] Field of Search ..... 428/43, 79, 33, 15, 428/16; 446/26, 27, 28; D6/584; D21/190

[56] References Cited

U.S. PATENT DOCUMENTS

| | | | |
|---|---|---|---|
| D. 278,453 | 4/1985 | Koper | D21/190 |
| D. 278,547 | 4/1985 | Koper | D21/190 |
| D. 290,206 | 6/1987 | Murphy | 428/79 X |
| 1,300,592 | 4/1919 | Essig | 428/79 X |
| 2,453,441 | 11/1948 | La Fair | 428/79 X |
| 3,439,447 | 4/1969 | Green | 446/27 |
| 3,988,792 | 11/1976 | Klein | 428/16 X |
| 4,027,340 | 6/1977 | Hadtke | 446/27 X |
| 4,285,068 | 8/1981 | Ross | 428/919 X |
| 4,594,276 | 6/1986 | Relyea | 428/40 |

*Primary Examiner*—Henry F. Epstein
*Attorney, Agent, or Firm*—Brumbaugh, Graves, Donohue & Raymond

[57] ABSTRACT

The full face decorative applique according to this invention comprises a full face image printed on a hypoallergenic self-adhesive material backed by easy release non-stick paper. The full face image is precut and prescored into at least five discrete facial sections for ease of application to the face. The facial image is divided into separate facial sections, one for the nose, two for the cheeks and eyes as well as separate sections for the mouth (lips) and for the chin. The separate sections of the image are precut so as to leave uncut pieces of the overall facial design between the various facial sections when they are removed from the backing.

3 Claims, 4 Drawing Sheets

FULL FACE DECORATIVE APPLIQUE

BACKGROUND OF THE INVENTION

This invention relates to a full face decorative applique and a method for applying same.

At various times throughout the year, especially at Halloween, it is traditional for both children and adults to dress in costumes and often to wear masks which not only enhance the costume but hide the wearer's identity. There were several serious drawbacks to conventional masks which full face appliques overcome. Not only are traditional masks warm to wear but they are often confining and restrict movement. In place of masks, some people apply makeup directly to their face in order to create a more realistic effect. It is time consuming and often expensive to apply effective makeup and many, especially children, lack the artistic talent and patience to achieve the desired effect.

It has now been discovered that the effect of professional makeup and/or a mask can be achieved using a sectioned full face applique which is preprinted with a mask or artistic design.

Prior to this invention, decorative products consisting mainly of hypoallergenic self adhesive "decals" were available. These decals consisted of two separate decorative sections for application about the eye and upper cheek areas of the face. Each decal had an opening for the eyes. These decals were backed with a hypoallergenic adhesive and were printed using non-toxic inks and were attached to an easily removable backing. Once the decal was removed from the backing, the backing material and any excess decal material were discarded. The decal was applied to the face by starting at the bridge of the nose and working outwards. These prior art decals as shown in FIG. 1 consists mainly of two eye sections and were available in different colors and various artistic designs and shapes.

It is an object of the present invention to provide a means and method for applying a design to the entire face not simply to a small area of the face. The result is a full face applique which is not only effective and realistic but inexpensive and easy to apply and wear.

SUMMARY OF THE INVENTION

The full face decorative applique according to this invention comprises a full face image printed on a hypoallergenic self-adhesive material backed by easy release non-stick paper. The full face image is precut and prescored into at least five discrete facial sections for ease of application to the face. The facial image is divided into separate facial sections, one for the nose, two for the cheeks and eyes as well as separate sections for the mouth (lips) and for the chin. The separate facial sections of the image are precut so as to leave uncut pieces of the overall facial design between the various facial sections and which remain when the facial sections are removed from the backing.

By sectioning the full facial image and leaving preprinted space between the sections an applique results which gives full facial coverage and achieves a realistic appearance. Moreover, the separate sectioning of the image allows it to be cut and adjusted during application in a manner which is adaptable to the contours, size and features of the wearer's face. In addition to full facial coverage, the sectioning of the image into distinct facial sections allows the applique after application to freely move with the wearer's facial movement. This enhances not only the overall appearance of the applique but also the user's comfort.

After removing and applying the separate facial area sections, the unique multi-section design also provides excess printed material between the sections which can be used to complete and customize the applique. This excess printed material which is part of the original image may be used to cover portions of the face which may still be visible after applying the separate facial area sections.

The separate facial area sections may also be lifted and repositioned over the edges of the mouth, chin and other facial features to create a more customized and realistic appearance and effect. Because of the nature of the self adhesive backing used to manufacture the applique, if applied and removed with care, the applique can be reused.

DESCRIPTION OF THE INVENTION

The invention will become apparent from the following detailed descriptions of the invention with specific references to the accompanying figures.

Figure 2:
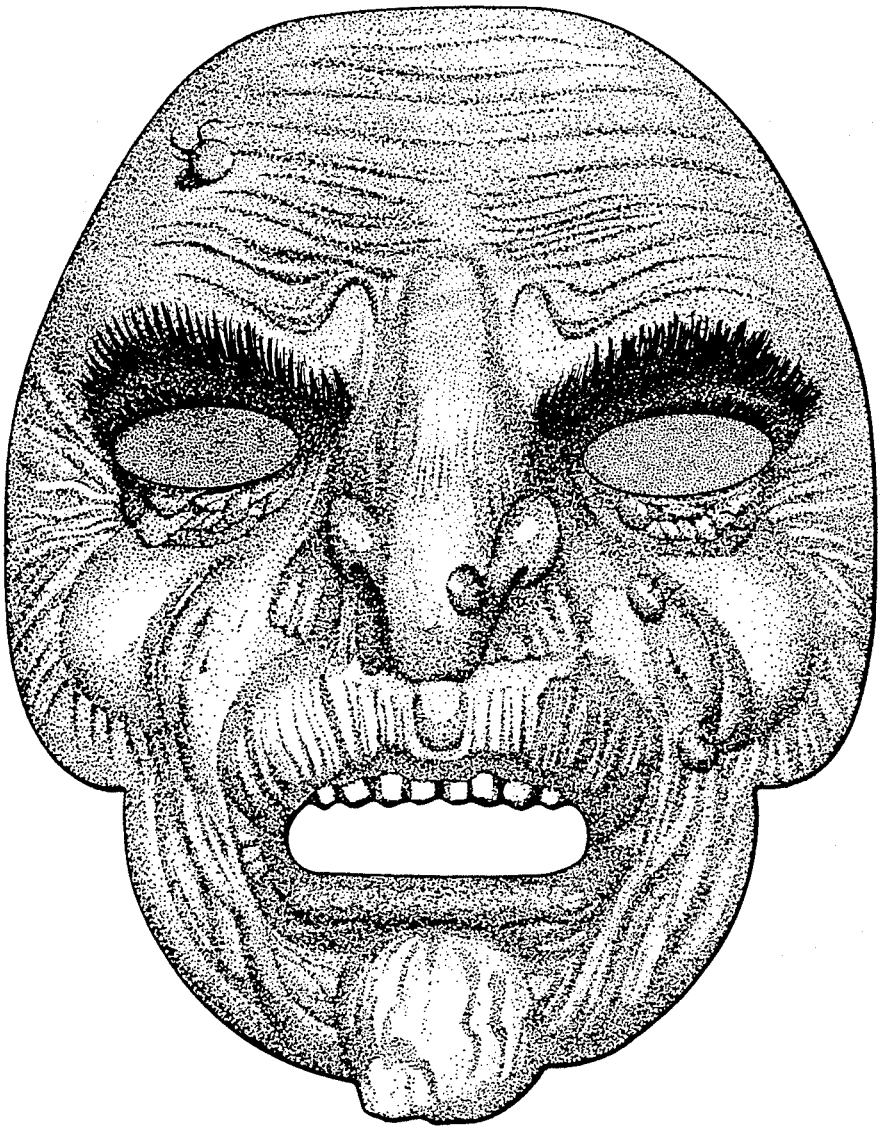
FIG. 2 shows the entire full face applique attached to the easy release paper.

An example of a full face applique (witch) as printed and prior to separation and application is shown in FIG. 2 still attached to the easy release backing paper with all of the separate sections intact.

Figure 1:
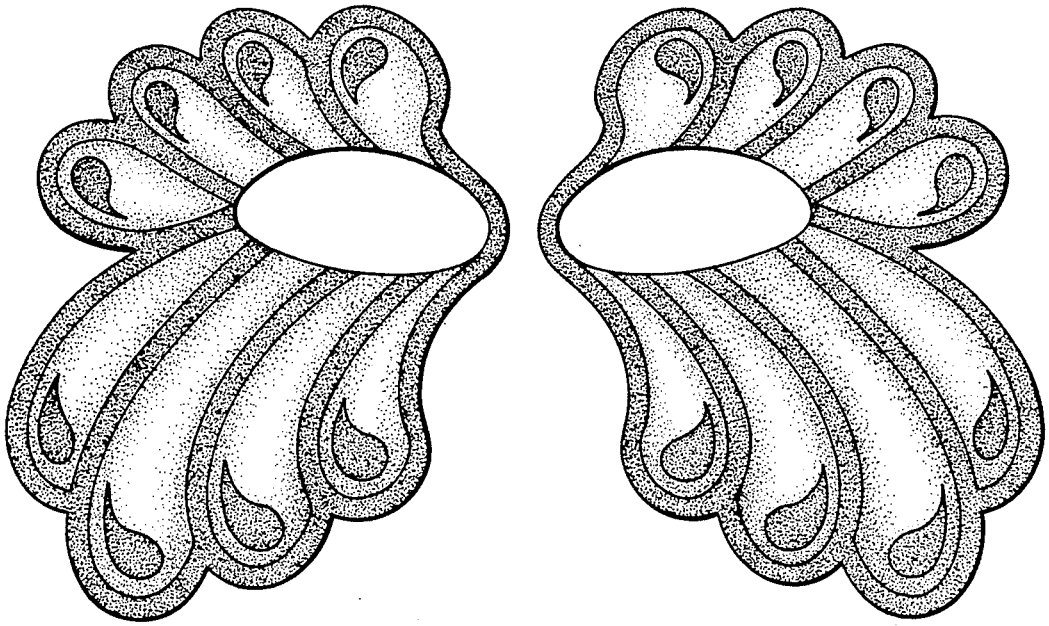
FIG. 1 is a known face decal.
Figure 3:
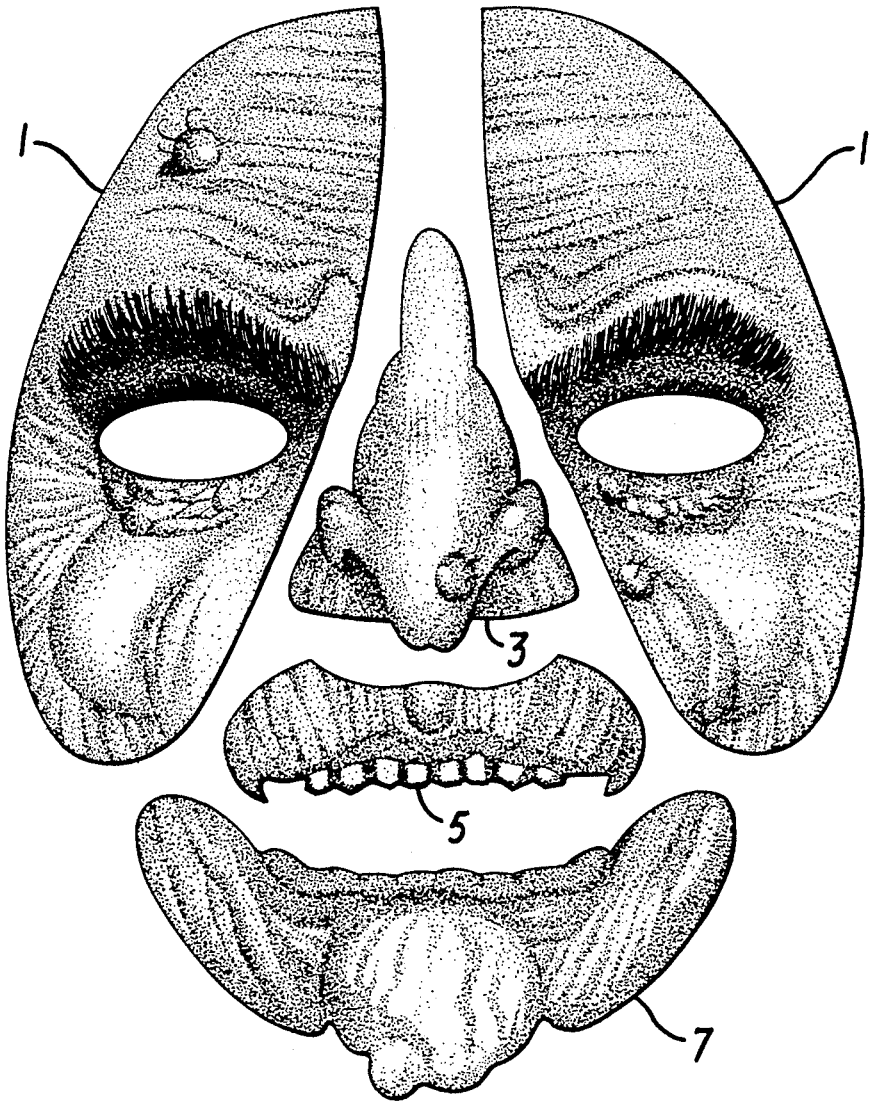
FIG. 3 shows the separate area facial sections shown in FIG. 2 removed from the easy release paper.

FIG. 3 shows the full face image of FIG. 1 removed from the easy release paper separated into the facial area sections ready for application. The eye sections 1, the nose section 3 along with the mouth (lip) 5 and chin 7 sections of the witch image are illustrated. Each separate area facial section 1, 3, 5 and 7 can be trimmed, positioned on the face, retrimmed and repositioned on the face for a more realistic affect. Further, any material remaining after having been trimmed away may be used to cover areas of the face not yet covered. The preprinted full face image can be of any realistic design, for example, an animal such as a tiger or gorilla or well known personality or historical figure or a fanciful design such as a cartoon or storybook character, for example, a clown, a skeleton, a vampire, werewolf or witch.

Figure 4:
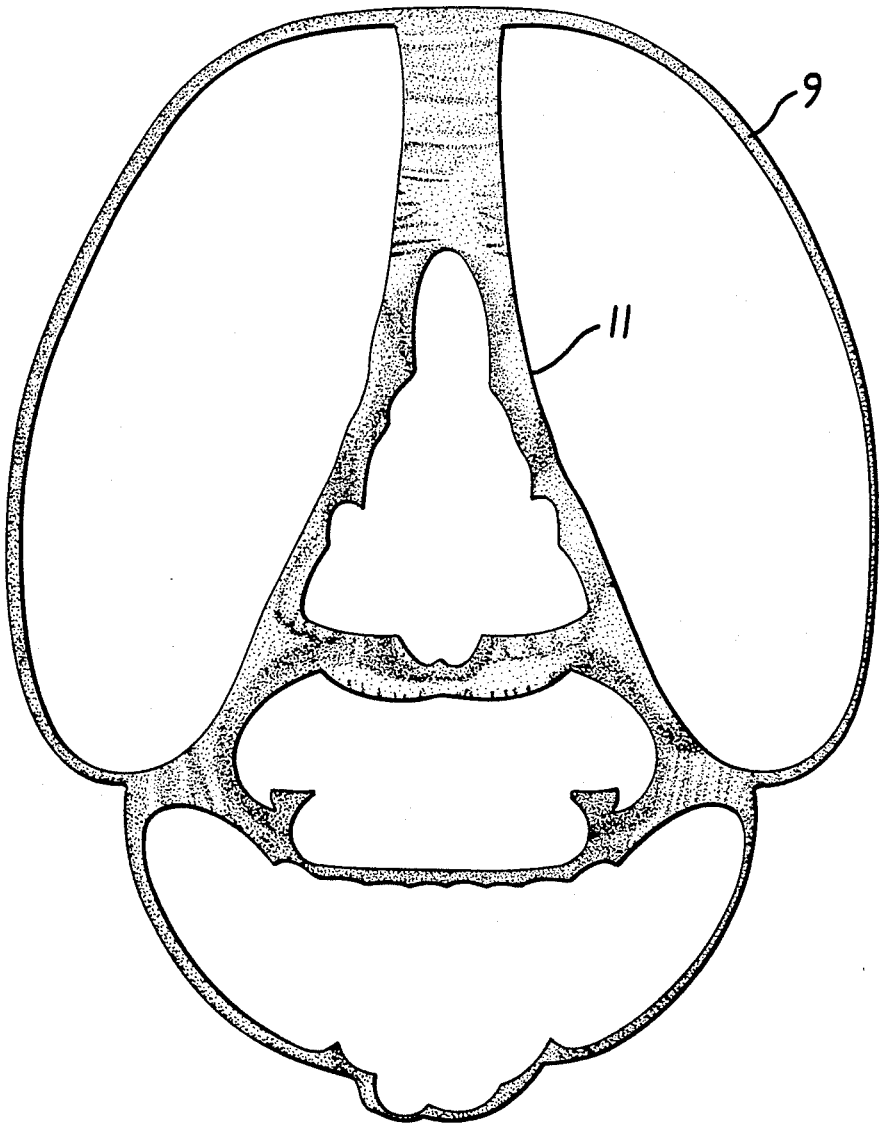
FIG. 4 shows the excess adhesive paper remaining after the sections forming FIG. 3 have been removed.

FIG. 4 shows the excess adhesive material remaining after the facial pieces of the witch image are removed from the backing paper. The outside and inside edges 9, 11 can be saved and can be cut and used to cover areas of the face not covered by the separate facial area sections and to fill in areas of the face not yet covered by the eye sections 1, nose section 3, mouth section 5 or chin section 7.

The full face applique is preferably made from a printable non-woven paper stock. Hypoallergenic adhesives and non-toxic inks such as Fitchburg #B-545-LCW are used to prepare the applique. The easy release paper is for example Fitchburg 40KB10 backing. The size of the applique is adjustable by trimming the separate sections but the image can also be printed in smaller overall size dimensions to make it easier to apply to a child's or small adult's face.

Although the full face applique is designed to create a complete visual effect, the overall effect can be further enhanced by combining it with appropriate clothing, hats, wigs and other costume accessories.

We claim:

1. A full face decorative applique comprising:

a full face image preprinted on adhesive paper backed by easy release paper, precut and prescored into at least five separate facial area sections including at least two eye sections, a nose section, a lip section and a chin section interconnected by printed adhesive paper.

2. A full face applique as disclosed in claim 1 wherein said adhesive paper is hypoallergenic.

3. A method for applying a full face decorative applique as described in claim 1 including:

removing separate facial area sections from the adhesive backing;

trimming excess adhesive paper off the separate facial area sections;

applying the trimmed separate facial area sections to the face overlapping the sections to form a mask covering the entire face; and using the excess adhesive paper to cover any exposed facial areas not already covered by separate facial area sections.

* * * * *